United States Patent [19]

Shapiro

[11] 4,132,983

[45] Jan. 2, 1979

[54] RADIO SYNCHRONIZED WARNING LIGHT SYSTEM

[75] Inventor: Haskell Shapiro, Corona Del Mar, Calif.

[73] Assignee: Royal Industries, Inc., Pasadena, Calif.

[21] Appl. No.: 824,074

[22] Filed: Aug. 12, 1977

Related U.S. Application Data

[63] Continuation of Ser. No. 648,180, Jan. 12, 1976, abandoned.

[51] Int. Cl.[2] ..... E01F 9/00; G08B 5/38; H05B 39/09

[52] U.S. Cl. ..... 340/331; 340/114 B; 340/28

[58] Field of Search ..... 340/331, 26, 28, 40, 340/114 R, 114 B; 343/225; 325/15, 16

[56] References Cited

U.S. PATENT DOCUMENTS

| | | | |
|---|---|---|---|
| 3,519,984 | 7/1970 | Zychal | 340/331 X |
| 3,787,867 | 1/1974 | Dodge et al. | 343/225 |
| 3,818,439 | 6/1974 | Maine | 340/114 B |
| 3,827,052 | 7/1974 | Tanaka | 325/15 |
| 3,938,080 | 2/1976 | Hulme | 340/114 B |
| 4,024,491 | 5/1977 | Pellerin et al. | 340/331 X |

*Primary Examiner*—Donald J. Yusko
*Attorney, Agent, or Firm*—Edward J. DaRin

[57] ABSTRACT

A warning light system constructed of an array of flashable, warning lights. The warning lights are self-contained, battery powered warning lights that may be arranged in an array and controlled to flash simultaneously. Each light includes an individual transceiving system for transmitting a coded, radio frequency signal to each other light of an array and a receiving radio frequency signal from each other light of the array to cause each lamp of each light to flash on and off in synchronism. Each light has a built-in transceiving antenna arranged within the light lens assembly and completely housed therein.

14 Claims, 9 Drawing Figures

69
68
67
ANTENNA-13
60
65
66
LEAD WIRE-70
16
71
72
62
74
73
70
61
RADIO FREQ. SYNCHRONIZED FLASHER TRANSCEIVER
10
BATTERY PACK
18

RADIO SYNCHRONIZED WARNING LIGHT SYSTEM

This is a continuation of application Ser. No. 648,180, filed Jan. 12, 1976; now abandoned.

BACKGROUND OF THE INVENTION

This invention relates to a warning light system and more particularly to an array of synchronous flashing warning lights for signaling a hazard or the like on a highway, for example.

Warning lights are extensively used on highways and on construction sites to signal certain hazardous conditions or areas to be avoided. A warning light of the type under consideration for the purposes of this invention is disclosed in U.S. Pat. No. 3,500,378. These warning lights are generally arranged to gain attention by causing the lamps to flash periodically. These flashing warning lights may be arranged in an array to outline the area to be avoided or to signal to a motorist a lane change must be made. When the warning lights that are arranged in an array flash in a random fashion without reference to the flashing of any other light in the array, this mode of operation produces what is known as a "firefly" effect. Attempts have been made by prior art techniques to provide a warning light system through the use of such flashing or blinking lights but to cause them to synchronously flash. The prior art techniques that have been employed generally employ a master/-slave relationship for achieving the synchronous flashing of the warning lights. One prior art example of this master/slave technique is disclosed in U.S. Pat. No. 3,787,867. These implementations generally require a single master transmitter for transmitting a signal to all of the lights in an array to cause the lights to flash in synchronism only in response to the signal transmitted from the master transmitter. These master/slave techniques generally require a precision oscillator to be employed in the master transmitter. The warning lights are also generally coupled together by connecting lead wires which makes it more difficult to readily arrange the warning lights in an array.

SUMMARY OF THE INVENTION

The present invention provides an improved and simple flashing warning light system capable of being arranged in an array so that each of the warning lights are flashed in synchronism with every other light in the array without the need to resort to a master transmitter and without the need for connecting wires strung between each lamp. The warning lights of the present invention are self-contained, battery powered flashing lights, with each light including an individual radiant energy transmitter and radiant energy receiver controlled to provide synchronous flashing. These units may be deployed exactly the same as conventional non-synchronous units except that all units will immediately flash in synchronism once they are energized.

Despite the fact that the units are battery powered, synchronization will be maintained if any light in an array is within the receiving range of any other light. This feature is of great importance when the invention is embodied in a highway warning light wherein transmitter power and antenna size are limited.

The inventive concepts of this invention allows low accuracy oscillators to be employed and to operate synchronously. The flash rate of the lights is controlled so that it is the rate of the fastest light of the array. Each unit flashes and its oscillator is reset in response to a signal received from any other unit of the array. The signal transmitted from each warning light may be a coded or modulated signal to prevent the lights from responding to unwanted transmission from other equipment or communication radios. In one specific embodiment of the invention the transmitted signal is a 15 to 20 millisecond burst of a modulated radio frequency signal. The radio frequency signal may be a 27.125 megahertz signal modulated by a 25,000 hertz signal.

The warning light of the present invention may not only be deployed as prior art lights but also similarly housed. The electronic circuits which may be integrated circuit modules, may be arranged within the conventional battery housing and the antenna housed within the lens assembly to reduce the risk of damage due to vandalism or the like.

From a method standpoint, the invention comprehends the method of operating an array of warning lights by including the steps of arranging a plurality of warning lights in an array while providing each warning light with a self-contained radiant energy transceiving system for transmitting radiant energy signals to each other light of the array and for receiving a radiant energy signal from the other lights of the array; coding the signals transmitted from each light to prevent reception at the lights of non-light generated signals and controlling all of the lights to cause all of them to illuminate in synchronism at preselected time intervals for preselected time durations. The synchronizing step includes the reception of a light generated signal from another one of the lights to assure the synchronous illumination of all of the lights of the array at the preselected time intervals; and controlling the transmission of the coded signals to restrict the signal transmission time to a preselected fraction of the time duration of the light illumination time during the preselected time intervals.

From an apparatus standpoint, the present invention provides a plurality of flashable battery operated warning lights arranged in a spaced apart relationship, each flashable light including a flashable lamp. The lights each include means for transmitting a radiant energy signal from a light to be transmitted to another light of the system and means for receiving a radiant energy signal from each other flashable light and producing an output signal in response thereto. Resettable timing means are provided for each warning light and are coupled to be responsive to an output signal from the individual light's receiving means for causing the timing means to be reset in response to an output signal therefrom and providing an output signal indicative of the resetting of the timing means. Means are also provided for coupling the output signal from the timing means to the individual lamp for momentarialy energizing the same and to the individual transmitting means to cause radiant energy signals to be transmitted from the warning light thereby energizing all the lights in synchronism.

These and other features of the present invention may be more fully appreciated when considered in the light of the following specificiation and drawings, in which.

Figure 1:
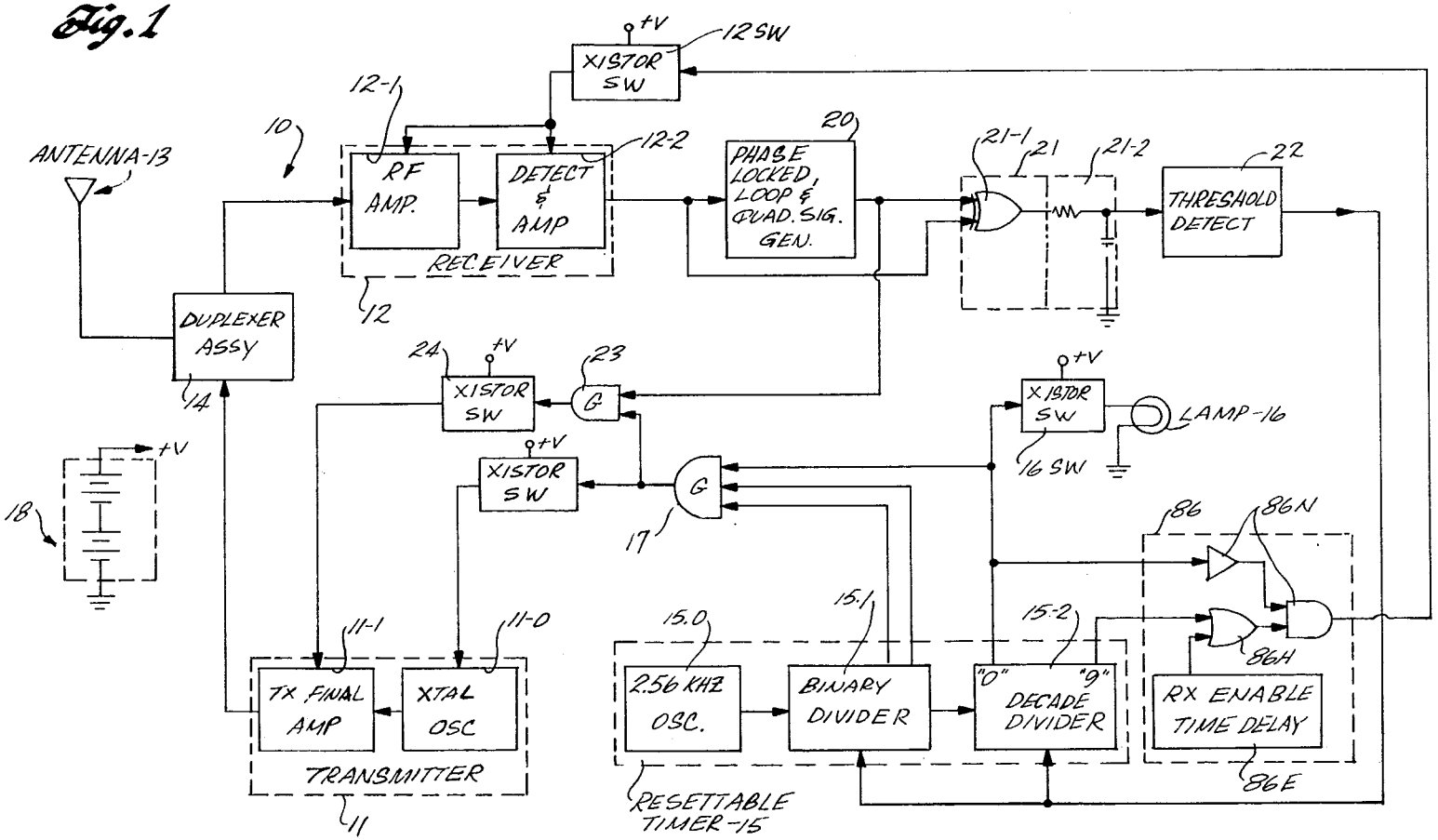
FIG. 1 is a general block diagram of the synchronous flasher transceiving system embodying the present invention.

Now referring to the drawings, the radiant energy synchronous flasher warning light system embodying the present invention will be described in detail. The synchronous warning light system of the present invention will be described as it may be embodied in a warning light of the type disclosed in U.S. Pat. No. 3,500,378 for convenience in describing the invention. It should be understood that it can be incorporated into any other blinkable light structure in accordance with the end use requiring synchronous flashing. The synchronous flashing warning light system will be disclosed as it may be embodied in such a prior art warning light wherein the radiant energy transmitted and received is in the radio frequency range and wherein each warning light includes a radio synchronized flasher transceiving system for controlling all the warning lights in an array to flash in synchronism.

With particular reference to FIG. 1, the general block diagram of a radio synchronized flashing transceiver system for use in a warning light will be examined. Each transceiver system 10 includes a radiant energy or radio frequency (RF) transmitter 11 and a radiant energy or RF receiver 12 for receiving signals transmitted from the other warning lights of an array and tuned to the same frequency as the frequency of the signals of an array transmitted from the transmitters 11. All of the transmitters transmit at the same radio frequency. In the particular embodiment under consideration, the transmitters 11 are tuned to transmit a radio frequency wave 27.125 megahertz modulated at 25 kilohertz. The transmitter 11 and the receiver 12 are coupled to a transceiving antenna 13 through an antenna duplexer 14 for individually coupling the RF signal received at the antenna 13 to the receiver 12 and for coupling the signal from the transmitter 11 to the antenna 13 for propagation to the other warning lights of an array. The duplexer 14 functions to couple these signals between the antenna 13 and the receiver 12 and the transmitter 11 respectively, while isolating and separating out these signals. The periodic transmission time intervals of the transmitter 11 are controlled by a resettable timer 15 providing a periodic control or reset signal for this purpose. For resettable timer 15 will produce a resetting output signal at the termination of a preselected time interval or will produce a resetting output signal in response to an output signal provided by the receiver 12. The output signal from the receiver 12 is effective for resetting the timer 15 to initiate a new timing interval irrespective of the fact that the preselected time interval has not expired.

The resettable timer 15, as illustrated in FIG. 1, comprises a 2.56 K hertz oscillator 15-0 having its output coupled to a pair of dividers illustrated as a scale of 256 binary divider 15-1 and a decade divider 15-2 arranged in cascade. The output signal from the binary divider 15-1 is a 10 hertz signal that is coupled as the input signal to the decade divider 15-2. The divider 15-2 may be a binary decimal counter having ten outputs. The two output terminals from the decade divider 15-2 that are employed are identified as the "0" and "9" outputs thereof. The "0" bit output signal signifies that the counter or divider 15-2 has been reset. When the preselected time period selected for the timer 15 has expired, an output signal will be produced at the "9" bit terminal of the divider 15-2 to automatically reset the timer 15 to start a new timing period. The output signals appearing at the "0" output terminal upon resetting of the counter 15-2 will be applied to control the conductive condition of a transistor switch 16SW for energizing the lamp 16 of the warning light for a preselected time interval or the time duration of the "0" bit time. Similarly, this same "0" bit signal will be applied to a gating network 17 for controlling the energization time period of the transmitter 11. Since the synchronous flasher transceiver 10 is powered from a battery power source 18, the input conditions to the gate 17 have been selected to control the time intervals that the transmitter 11 is in a transmit mode to a preselected fraction of the time period that the lamp 16 is energized to conserve power. To this end, two output signals from the first binary dividing stage 15-1 of the reset timer 15 are applied to the gate 17 in combination with the "0" bit signal from the decade divider 15-2 so that the an output signal will be produced from the gate 17 only during the time interval that the selected output signals from the binary divider 15-1 exist or approximately one-fourth of the time period of the "0" bit time. The output signal from the gate 17 is applied to a transistor switch 18 for switching power to the oscillator 11-0 of the transmitter 11 thereby conditioning the transmitter 11 for transmitting a signal from the warning light by means of the duplexer 14 and the antenna 13 for propagation of the signal through space.

The receiver 12 is tuned to respond to a signal transmitted from another warning light of the array coupled thereto through the antenna 13 and the duplexer 14 and apply it to the RF input amplifier stages 12-1 of the receiver 12. The amplified RF signals will then be detected and decoded or demodulated at element 12-2 to provide an audio output control signal of 25 KHz from the receiver 12. The audio output control signal in this instance is applied to a phase locked loop circuit and quadrature signal generator 20. The quadrature signal from element 20 is combined with the received signal in an "exclusive OR" gate 21-1 and the resultant is passed through the low pass filter network 22-2 for applying a signal to a threshold detector 22. When an output signal is provided from the threshold detector 22, it is applied to the resettable timer 15 for resetting the timer in response to the reception of the warning light signal transmitted from a unit of the array and received at the receiver 12. For this purpose, the decade divider 15-2 is conditioned during the "9" count time interval to allow the timer 15 to be reset and the output signal provided upon reset to flash the lamp 16 and energize the transmitter 11 thereby synchronizing the transceiving system 10 at each warning light of the array in response to the fastest warning light of the array.

The audio output signal from the phase locked loop 20 is also coupled to a gating element 23 in combination with the output signal from the gate 17 for applying the audio signal from the phase loop 20 to the transmitter 11 for modulating the carrier wave signal generated by the oscillator 11-0 of the transmitter 11. The output signal from the gating element 23 actuates a transistor switch 24 which switches power onto the modulator and final amplifier 11-1 of the transmitter 11. The output signal from the transmitter 11, then, is a modulated radio frequency signal which is propagated from the antenna 13.

Each warning light is provided with such a synchronous flasher transceiving system 10 for transmitting a signal to each other warning light of an array and for receiving a signal from each other warning light. This combination of elements coacting with the resettable timer 15 will cause each transmitter 11 to transmit a coded RF signal and each warning light to flash each time the timer 15 is reset. In the event one transceiving system 10 for a light is faster than the other transceiving systems of the same array of lights, its transmitted signal will be received at the other transceiving systems and will cause all of the other transceiving systems to have their timers 15 to be reset and all of the lamps 16 to flash in synchronism. Although each transceiving system 10 for each warning light may require a finite amount of propagation time, the time intervals are so small as to be negligible compared to the timing interval and imperceptible to the human eye. Therefore, all warning lights operating in the same array appear to the eye to flash in perfect synchronism.

Figure 3:
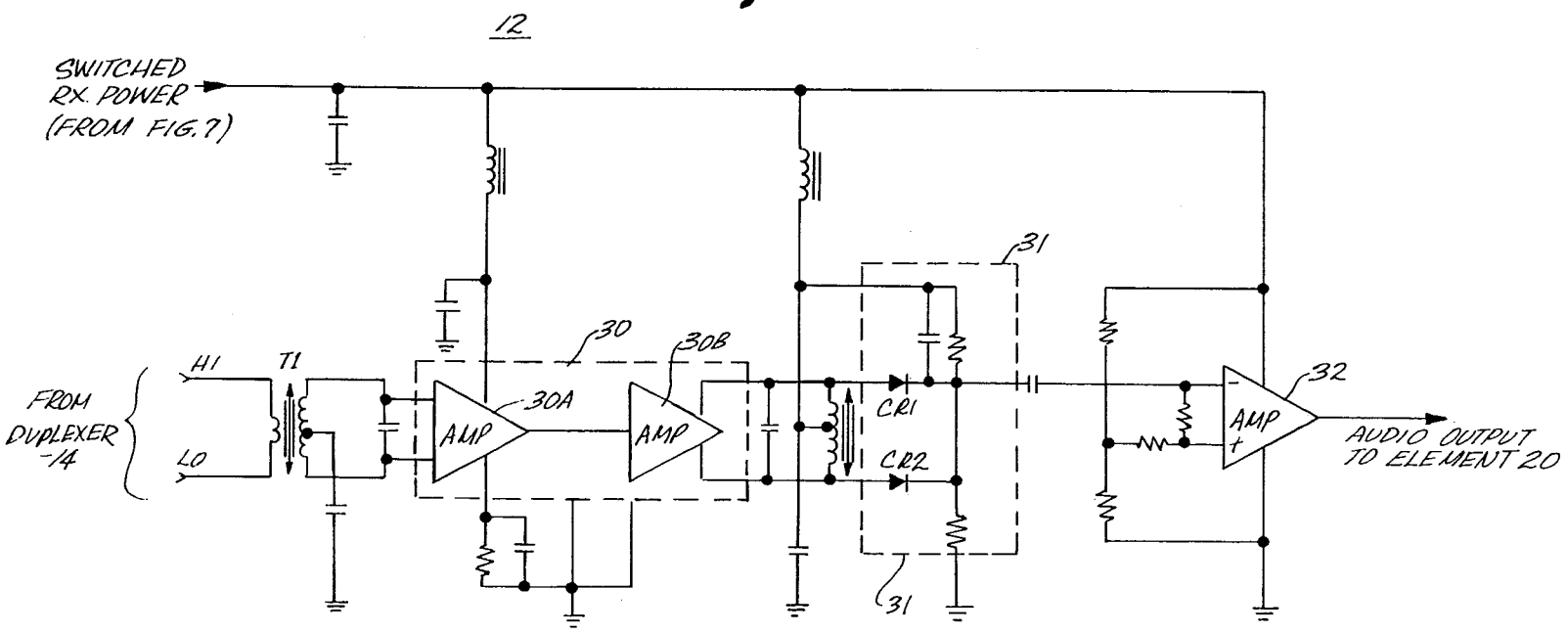
FIG. 3 is a schematic circuit diagram of the receiver and audio amplifier sub-assembly of the flasher transceiving system of FIG. 1.

Now referring to FIG. 3, the schematic circuit diagram of the receiver sub-assembly 12 for the transceiving system 10 will be examined. The input to the receiver 12 will be assumed to be coupled to receive a signal from the duplexer 14. The output terminals from the duplexer 14 then are applied to an input matching transformer, identifed as the transformer T1. The modulated radio frequency signal derived from the secondary winding of the matching transformer T1 is applied to two stages of radio frequency amplification shown in FIG. 3 as comprehended by the general block 30. The radio frequency stages 30 comprise two serially arranged radio frequency amplifiers 30*a* and 30*b*, the output signal from the second stage of the radio frequency amplification or the stage 30*b* is applied to a radio frequency detector or a demodulator 31. The detector 31 is of conventional construction and comprises a diode detecting network including the diodes CR1 and CR2. The output of the diode detecting network 31 is the demodulated audio signal of 25 KHz and is applied to an audio amplifier for amplifying the 25,000 hertz signal. The audio output from the amplifier 32 is applied to the phase locked loop circuit 20 as will be described in more detail hereinafter. The application of power to the receiver 12 including the audio amplifier 32 for sub-assembly 12 is controlled by the transistor switch 12SW to apply power thereto during the time intervals that the decade divider 15-2 of the resettable timer 15 is in the "9" count as described hereinabove. During this time interval, the receiver 12 is powered and is conditioned to receive a signal from the remaining warning lights of the array. This time interval is just prior to the normal time for resetting the timer 15.

Figure 4:
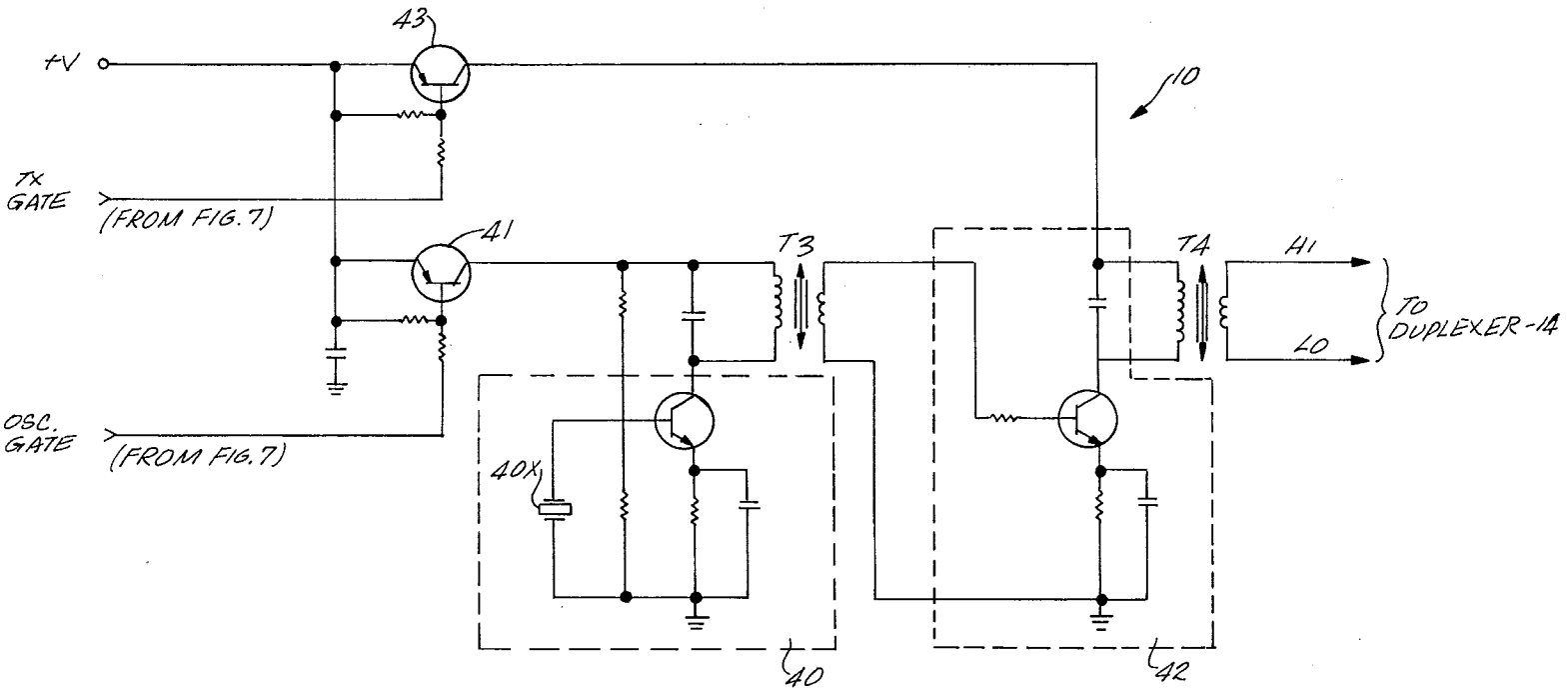
FIG. 4 is a schematic circuit diagram of the transmitting sub-assembly of the transceiver of FIG. 1.

Now referring to FIG. 4, the transmitter subassembly 11 circuit organization will be examined in more detail. The transmitter subassembly 11 comprises a crystal oscillator circuit 40 arranged for generating a radio frequency carrier wave signal of 27.125 mHz and is of conventional construction. The crystal oscillator 40 employs a commercially available crystal 40X arranged in a transistor oscillating circuit for providing the desired oscillatory signal at the output transformer T3. The power to the oscillator 40 is controlled by a transistor switch 41 which controls the time intervals that the oscillator is powered in accordance with the time intervals that the timer 15 is reset. The switch 41 is rendered conductive for this purpose when the voltage at its base electrode is in a "True" state. This "True" state exists during a portion of the "0" time intervals of the divider 15-2 or for approximately 25 milliseconds. The oscillator output appearing at the output transformer T3 is applied to an amplifier circuit 42 which combines the modulating signal derived from the phase locked loop element 20 with the carrier wave signal from oscillator 40. This amplifier circuit 42 is controlled by a transistor switch 43 which applies the modulating signal at the output of the transistor 43 to the amplifier 42. The switch 43 is closed when switch 41 is closed and the modulating 25 kilohertz signal generated by the phase locked loop signal generator is "true". This action makes the output of amplifier 42 an approximately 20 millisecond burst of a 27.125 megahertz radio frequency signal modulated at 25 kilohertz. The modulated output signal from the amplifier 42 is applied through the transformer T4 to the duplexer 14 for transmission into space by the antenna 13. It will be appreciated by those skilled in the art that the generation of a modulated carrier signal in terms of the schematic diagram of FIG. 4 is of conventional construction and any other convenient transmitting circuit may be employed for the purposes of the present invention.

Figure 5:
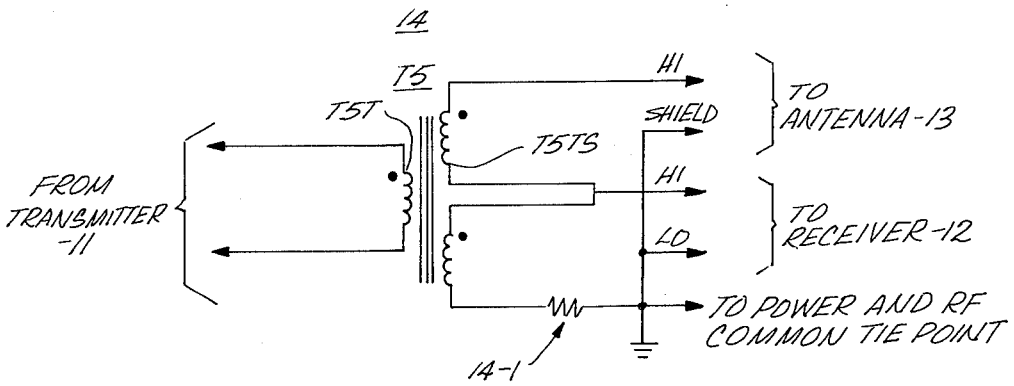
FIG. 5 is a schematic circuit diagram of the antenna duplexer for the transceiving system of FIG. 1.

Now referring to FIG. 5, the schematic diagram for the antenna duplexer 14 for use with the transceiving system 10 will be examined.

Figure 2:
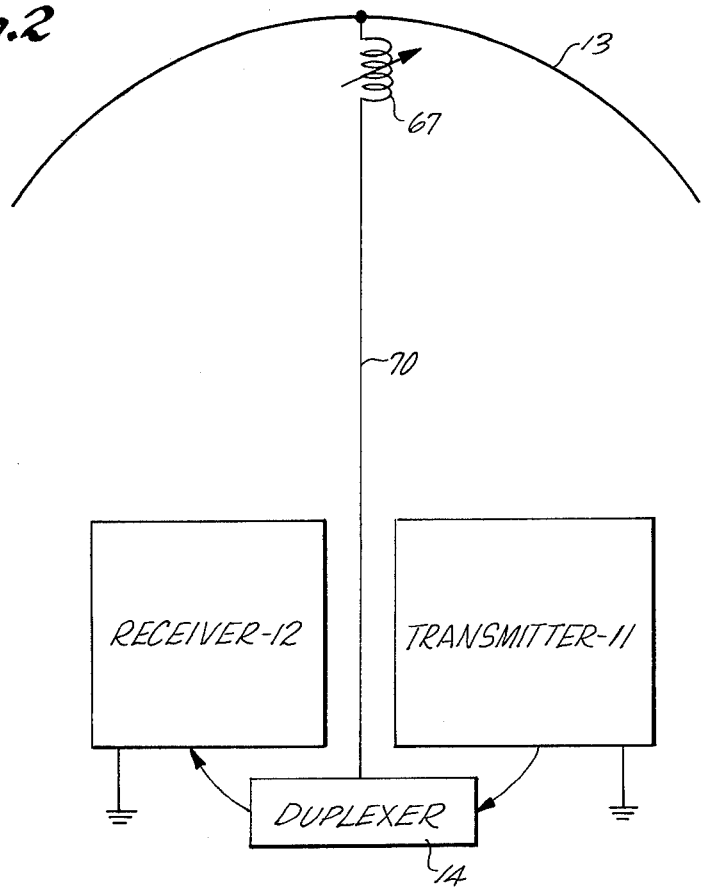
FIG. 2 is a diagrammatic representation of the antenna system employed in the transceiver of the present invention.

The function of the duplexer 14 can be appreciated from examining FIG. 2 wherein the antenna 13 is diagrammatically illustrated as coupled to the duplexer 14. The signal received by the antenna 13 is coupled to the receiver 12 of the system. The signal generated at the transmitter 11 is coupled through the duplexer 14 for propagation in space by being radiated from the antenna 13 but is prevented from reaching the receiver 12.

The duplexer 14, as illustrated in FIG. 5, comprises a transformer T5 with an input winding of the transformer connected to the output terminals of the transmitter 11. The output winding of transformer T5 is center tapped. Across the entire winding is connected the series combination of the antenna 13 and resistor 14-1. Resistor 14-1 is of a value equal to the radiation resistance of the antenna. The signal that is coupled to the receiver 12 is the difference in voltage that exists between the junction of resistor 14-1 and antenna 13 and the center tap of the output winding of transformer T5. If the resistance of resistor 14-1 is equal to the radiation resistance of antenna 13, then this voltage difference is zero and no portion of the transmitter power appears at the receiver. Half of the transmitter power is coupled to the antenna and half dissipated in resistor 14-1. Signals received by antenna 13 are divided between the transmitter 11, the resistor 14-1, and the receiver 12. Hence the action of the duplexer 14 is to prevent the signals generated by the transmitter 11 from reaching the receiver 12 but to be coupled to the antenna 13 and to permit the signals received by antenna 13 to reach the receiver 12.

Figure 6:
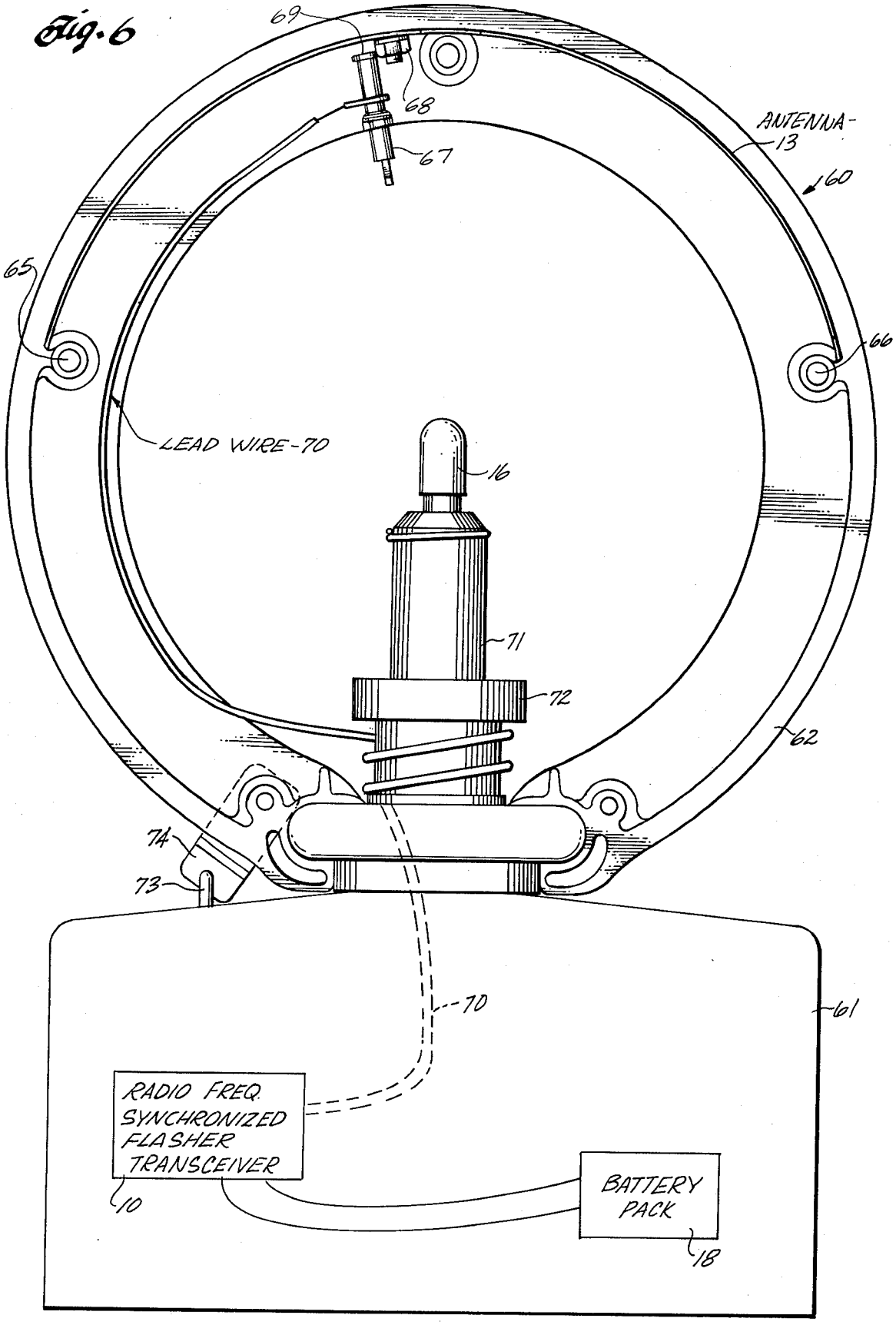
FIG. 6 is a front elevational view of the warning light embodying the present invention, with one-half of the warning light lens removed and illustrating the location of the battery and synchronous flasher transceiver within the battery housing in block diagram form.

The assembly of the radio frequency flasher transceiver 10 into a conventional warning light is illustrated in FIG. 6. The warning light 60 illustrated in FIG. 6 comprises the conventional combination of battery housing 61 and lens assembly 62. The housing 61 in this instance houses a battery 63 for powering both the lamp 16 and the radio frequency synchronous flasher transceiver 10. The transceiver 10 is also mounted within the housing 61, as illustrated. The warning light 60 is illustrated as the general construction disclosed in U.S. Pat. No. 3,500,378. To this end, the lens assembly 62 illustrated in FIG. 6 has one-half of the lens removed to allow the interior construction of the mounting for the lamp 16 and the antenna structure and coupling to be examined in detail. The antenna 13, as illustrated, is a strip of aluminum which may be molded integral with the lens 62 or cemented or clipped in place. As illustrated, the strip of aluminum comprising the antenna 13 is arranged to follow the contour of the lens assembly and extends from the one lens fastener aperture 65 arranged on the left hand side of the lens 62 to the fastener aperture 66 arranged on the opposite side of the lens. The aluminum strip may be 0.88 inch in width with widths of approximately 0.468 inch to clear the three fastener apertures. The antenna 13 includes a tuning element 67 which may be an adjustable inductor incorporating a ferrite core. The inductor 67 may be cemented to the lens 62 as illustrated. The inductor 67 is electrically coupled to the antenna aluminum strip 13 through the provision of a flathead screw 68 secured thereto and a solder lug 69 carried by the screw to provide the conductive path with antenna 13. The solder lug 69 is soldered to the inductor 67 and the inductor in turn is soldered to the lead wire 70. The lead wire 70 is arranged to follow the circular contour of the lens assembly 62 as illustrated and is wrapped around a lamp mounting post 71 that is secured to the housing 61 as more fully described in the aforementioned U.S. Pat. No. 3,500,378 and which disclosure is incorporated here by reference. The post 71 includes a loop retaining ring 72 mounted thereon. The lead wire 70 is wrapped around the post 71 loosely in terms of a couple of wraps around the post and the free end of the lead wire is passed through the post mounting structure into the housing 61 where it is connected to the transceiving circuit 10. The loop retainer 72 may be a rubber ring and is provided to keep the loose loops of lead wire 72 arranged below the retainer near the bottom portion of the post 71. The two loose wraps of the lead wire 70 arranged around the post 71 function as a strain relief for the lead wire. To prevent breakage of the lead wire 70 during the assembling of the lens elements, the normal construction of the lamp is modified to prevent the complete 360 degree rotation of the lens assembly 60 relative to the housing 61. For this purpose, a stop pin 73 is provided and constructed to extend upwardly from the top portion of the housing 61 for coaction with a stop member 74 secured to the lens assembly 62. The stop member 74 extends outwardly in an angular relationship with the lens assembly 62 for engaging the stop pin 73 and thereby limiting the rotation of the lens assembly. This construction is defined to limit the rotation of the lens assembly 60 to just under 360 degrees.

Figure 7:
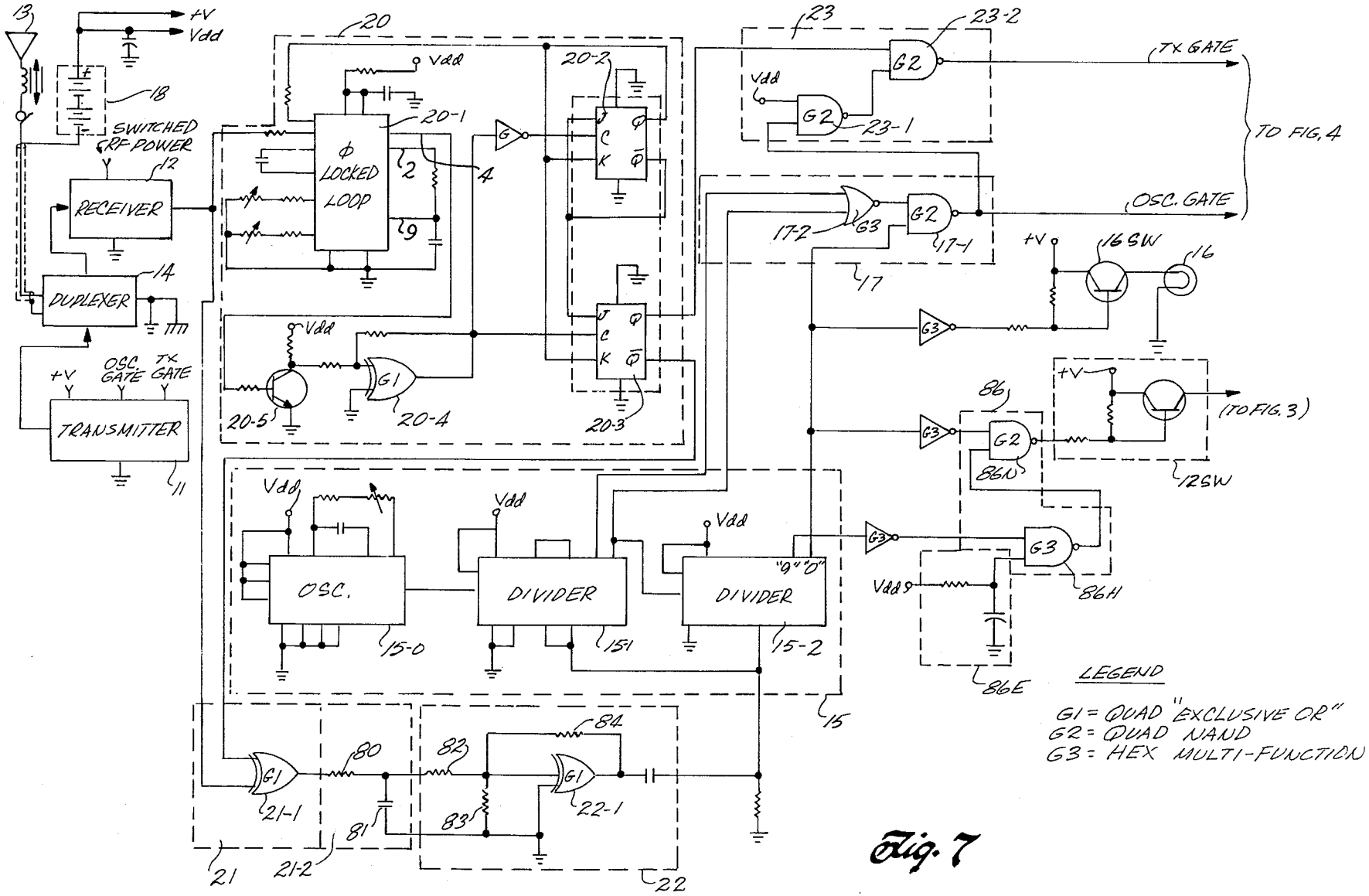
FIG. 7 is a detailed block-schematic diagram of the synchronous flasher transceiving system of FIG. 2.

Now referring to FIG. 7, the detailed block schematic diagram of the radio flasher transceiver 10 for the warning light will be examined in greater detail. FIG. 7 illustrates the radio synchronized flasher transceiver 10 as it may be constructed in terms of commercially available integrated circuits. These integrated circuits are employed for each of the sub-assemblies such as the transmitter 11 and the receiver 12 as well as the resettable timer 15. This includes the construction of the oscillator 15-0 for the timer 15 and the binary divider 15-1 and decade divider 15-2. The gating elements employed in the system are also selected from available circuits and the exact nature of the gating elements will be described hereinafter. The transmitter 11 and receiver 12, as well as the resettable timer 15, are illustrated in FIG. 4 in general block form while the remaining elements are shown in more detail and will be described in detail to integrate them into the overall transceiving system 10.

Now referring to the phase locked loop and quadrature signal generator 20, it should be noted that this element is coupled to receive and be operative on the audio output signal from the receiver 12. The phase locked loop element 20 functions in response to the audio output signal from the receiver 12 to provide the same frequency of audio output signal as received but shifted in phase by 90 degrees. For this purpose, the element 20 includes a phase locked loop circuit 20-1 for providing a shift in phase of the audio signal received from the receiver 12 in combination with a pair of J-K flip-flops 20-2 and 20-3. The input terminals to each of the flip-flops 20-2 and 20-3 are identified in a conventional fashion as the J, C and K input terminals, reading from top to bottom as illustrated in FIG. 7. The pair of output signals from each flip-flop are identified as the Q and Q outputs. The phase locked loop circuit 20-1 has its output signal coupled to a quadrature Exclusive OR circuit identifed as 20-4. A switching transistor 20-5 is arranged between the output terminal denoted "4" for the element 20-1 and an input terminal to the Exclusive OR circuit 20-4. The other input terminal to the exclusive OR circuit 20-4 is coupled directly to ground. The output signal from the Exclusive OR circuit 20-4 is coupled directly to the clock or "C" input terminals for each of the flip-flops 20-2 and 20-3.

The Q output signal from the flip-flop 20-2 is coupled as an input signal to the K input terminals of both of the flip-flops 20-2 and 20-3. In the same fashion, the Q output signal from the flip-flop 20-2 is coupled as the input signal to the "J" input terminals for each of the flip-flops 20-2 and 20-3. The Q output for the flip-flop 20-3 is applied to one of the input signals to the gating element 23 which will be described immediately hereinafter. The Q output terminal for the flip-flop 20-3 provides the audio output signal of the same frequency as derived from the receiver 12 but shifted in phase 90 degrees. This Q output signal is coupled directly as an input signal to the Exclusive OR phase detector and ripple filter element 21.

The Exclusive OR circuit of the element 21, illustrated in FIG. 7, is a quadruple Exclusive OR circuit which is constructed as an integrated circuit and has one input connected to directly receive the output signal from the Q output terminal of the flip-flop 20-3. The other input terminal to the Exclusive OR element 21-1 is connected directly to the output of the receiver 12. The output signals from the exclusive OR circuit 21-1 is applied to a ripple filter element, generally identified as 21-2, comprising an RC circuit consisting of a resistor 80 and a capacitor 81. The output signal from the filter element 21-2 is applied to a threshold detector 22. The threshold detector 22 includes a quadruple Exclusive OR circuit 22-1 having two input terminals. One input terminal of the Exclusive OR circuit 22-1 is connected directly to ground. The other input terminal of circuit 22-1 is connected to sense the threshold voltage at the junction between the resistor 80 and the capacitor 81. To this end, a threshold voltage level is defined by the threshold resistors network identified as resistors 82, 83 and 84. The resistor 82 is connected in series circuit relationship with the resistor 80 and the input terminal to the Exclusive OR element 22-1. The resistor 83 is connected in common with the resistor 82 and the input terminal to the gate 22-1 and ground. The resistor 84 is coupled between the output terminal of the gate 22-1 and its active input terminal in common with the resistors 82 and 83. The output signal from the Exclusive OR gate 22-1 is coupled directly as a resetting input to the binary divider 15-1 and the decade divider 15-2 to reset these dividers.

The phase locked loop and signal quadrature generator circuits 20 are provided so that the system may uniquely recognize a signal received from the other warning lights of an array of lights. This particular arrangement is provided so that a continuous output will be derived from the output of the Exclusive OR circuit 21-1. Accordingly, the provision of the audio output signal from the receiver 12 and the audio signal shifted in phase from the element 20 provides such a continuous output signal at the output of the Exclusive OR gate 21-1. This will provide an average voltage appearing at the junction between the resistor 80 and 82 that is always less than the threshold voltage defined by the aforementioned threshold resistor network except when a signal is received by the receiver 12 from another warning light of the array. Accordingly, when a signal is provided from the receiver 12, the average voltage from the Exclusive OR circuit 21-1 at the junction between the resistors 80 and 80 will exceed the defined threshold voltage and an output signal will be derived from the Exclusive OR network 22-1. This output signal is used for resetting both the dividers 15-1 and 15-2 of the resettable timer 15 and will reset the timers irrespective of the fact that the timing interval has not completely elapsed. It will be recalled from the above description that during the "9" bit time of the counter 15-2, the system will be conditioned to look for a signal from the other transceiving systems of the blinking light array to determine if the timers 15 are to be reset and thereby synchronize all of the warning lights in accord with the fastest light of the array. If a signal is received during this "9" time interval, the timer 15 will immediately reset including the resetting of the element 15-2 to "0" and cause the lamp 16 to momentarily flash and a signal to be transmitted from the transmitter 11. If no signal is received from another warning light of the system during the "9" bit time interval, the timer will be automatically reset at the termination of the "9" time and will restart a timing cycle.

The "0" bit terminal of the decade divider 15-2 is coupled to a gating element 86 for controlling the conductive time interval of the transistor switch 12SW for applying power to the receiver 12. The gating element 86 comprises a quadruple NAND gating element 86N and a gating element 86H, illustrated as two input gating elements. One of the input circuits for the NAND circuit 86N is coupled directly to the "0" output of the divider 15-2. The other input to the NAND element 86N is coupled to receive the output signal from the gating element 86H. The gating element 86H consists of a hex multifunction gating element which consists of a group of gating elements constructed in terms of integrated circuitry. The one input terminal to the gating element 86H is connected to receive the "9"'s output from the divider 15-2. The other input terminal to the gate 86H is coupled to an enabling time delay circuit 86E to speed up the synchronous operation of the warning light when power is initially applied to the system by maintaining the receivers 12 of the system in a conductive condition for several seconds after power is applied. This enabling time delay circuit 86E is operative to apply power to the receiver 12 by the provision of an output from the gating element 86H. This will cause the receiver to be powered for approximately five seconds only at "turn on" time. At other times during the operation of the system, the "9" output signal from the divider 15-2 must be present to provide an output signal to switch power onto the receiver 12. The "0" output signal from the divider 15-2 is coupled to a gating network identified as element 17.

The gating element 17 comprises a quadruple NAND circuit 17-1 and a hex multifunction element 17-2. The "0" signal from the divider 15-2 is applied directly as one input of the NAND gate 17-1. The other input to the NAND circuit 17-1 is derived from the output signal from the element 17-2. The multifunction element 17-2 receives its two input signals from two outputs from the binary divider 15-1. The two input terminals identified in FIG. 7 as the terminals "13" and "14" from the divider 15-1 are coupled directly as input signals to the element 17-2. These two output terminals provide signals from the divider 15-1 that exist for a time period which is approximately one-fourth of the time interval that the "0" of element 15-2 is in a "True" condition. These signals are utilized to control the length of time that the transmitter oscillator 11-0 and the transmitter power amplifier 11-1 are powered so as to be powered only a fraction of the time that the lamp 16 flashes thereby saving the battery power. Accordingly, when either of the signals from the divider 15-1 or the "0" bit signal from the divider 15-2 are present at the inputs to the element 17-1, an output signal is provided therefrom. This output signal from the element 17-1 is applied directly to power the oscillator 11-0 of the transmitter 11.

In addition, the output signal from gate 17-1 is applied to gating element 23. The gating element 23 consists of a pair of two input quadruple NAND circuits 23-1 and 23-2. The output signal from the element 17-1 is applied as an input signal to the NAND circuit 23-1 along with a fixed potential level for the other input terminal. The output signal from the element 23-1 is applied directly as an input signal to the NAND circuit 23-2. The other input signal to the NAND element 23-2 is derived from the Q output of the flip-flop 20-3. The output from the gating element 23 is provided by the NAND gate 23-2 and provides the modulating signal to the transmitter 11. The modulating signal is coupled to the transmitter only at the time intervals that the dividing element 15-2 is in the "0" bit time. This, then, will apply the modulating or audio signal derived from the element 20 to the modulator 42 of the transmitter 11 to allow a modulated RF signal to be transmitted. It will also be noted that during the "0" bit time interval of the divider 15-2 that this signal is applied to the switch 16SW to render it conductive and thereby energize the lamp 16 for the preselected flash period of 100 milliseconds.

Figure 8:
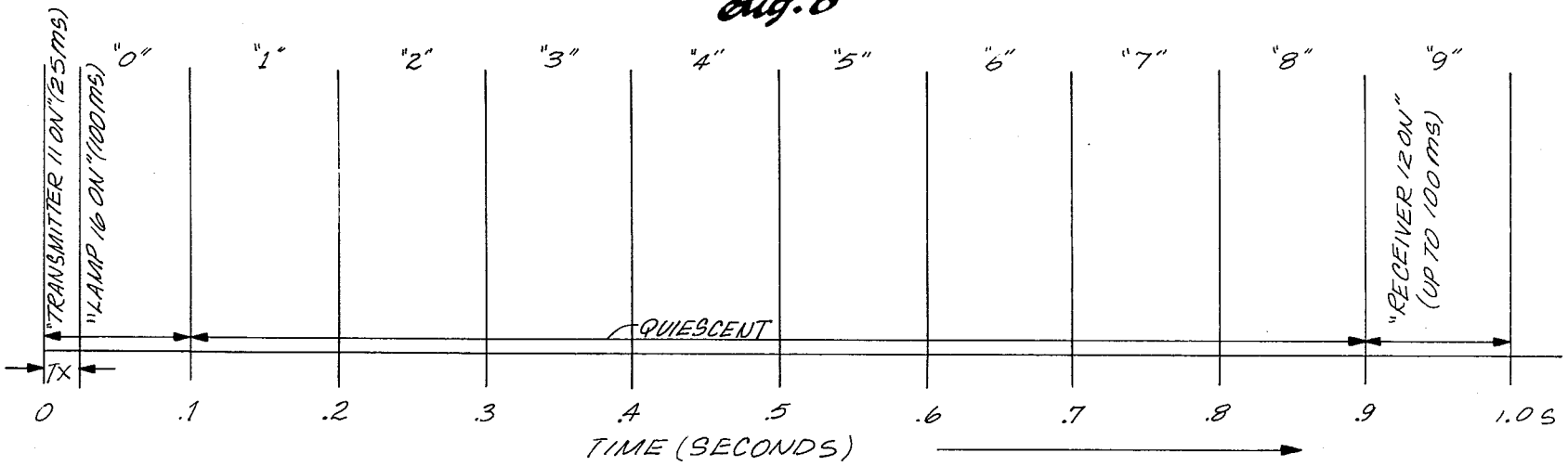
FIG. 8 is a graphical illustration of the transmitting and receiving timing cycles for the transceiving system of FIGS. 1 and 7.

With the above structure in mind, then, the operation of the synchronous flasher transceiver 10 can be summarized. With the application of power to the transceiving system 10 for each blinker light, only those elements that are needed to function will be powered. The other elements will be powered when their function is required. During the initial power interval, as a result of the provision of the enabling time delay circuit 86E at the input of the gate 86H, the receiver 12 will be powered for approximately five seconds after the power is turned on to determine if any of the warning lights of the array are transmitting a signal for synchronizing purposes. In the event a signal is transmitted during this interval and is received at the receivers 12 it will function to reset the timer 15 at each light and to cause the light to flash in synchronism and a signal to be transmitted therefrom so that all of the warning lights will flash synchronously. If no signal is received by the receiver 12 during this interval, the power to the receiver 12 will be terminated and the system will operate to commence the timing cycle. The timer 15 will then commence to respond to the output signal from the oscillator 15-0 and provide the necessary timing function through the operation of the dividers 15-1 and 15-2. When the timer 15 has reached the time period when the "9" time interval is reached by the divider 15-2, the battery power is applied to the receiver 12 in response thereto. This results due to the output signal provided from the gating element 86 in response to the "True" condition of the "9"'s terminal of the decade divider 15-2 being applied as an input signal to the gating element 86H and thereby the NAND gate 86N to render the switch 12SW conductive for powering the receiver 12. The receiver 12 is powered during this interval for up to 100 milliseconds; see FIG. 8. If during this interval no signal is received from the other warning lights of the array the timer 15 will continue to count and at the end of the "9"'s count will reset the timer for restarting a new timing period.

With the resetting of the timer 15 the "0" output from the element 15-2 will provide an input signal to the gating element 17 to switch the power on to the transmitter 11 as well as power the lamp 16. The lamp 16 will be energized during the complete time interval that the "0" count exists at the divider 15-2 or for 100 milliseconds. Due to the provision of the gating element 17, the transmitter 11 will be powered only a fraction or one-fourth of the time interval alloted to the "0" time. As noted in FIG. 8 this transmission time is approximately 25 milliseconds of the 100 milliseconds alloted to the energization of the lamp 16. As is further evident from FIG. 8, the total elapsed time for the divider 15-2 is 1.0 seconds. During counts 1–8, the system is quiescent in the sense that the lamp 16 is off and the transmitter 11 and receiver 12 are not powered. The receiver 12 is powered during the "9" time period. With the transmission of a signal from the transmitter 11, it is applied to the antenna 13 through the duplexer 14 and radiated through space to the remaining warning lights.

If it is assumed that during the "9"'s count of the divider 15-2, a signal is received at the antenna 13 from one of the other warning lights of an array, the signal will be coupled to the antenna 13 through the duplexer 14 to the receiver 12. The receiver 12 during this time interval will have been powered as the result of the "9" output being "True" and controlling the conductive condition of the switch 12SW through the gating network 86 comprising the gates 86H and 86N for switching power onto the receiver. With the reception of the signal at the receiver 12, the audio output signal is coupled to both the element 20 and the Exclusive OR circuit 21-1. Accordingly, the output signal from the Exclusive OR circuit 21-1 will exceed the defined threshold level so that the output signal from the Exclusive OR circuit 22-1 will reset the dividers 15-1 and 15-2. The resetting of the timer 15 will at this time flash the lamp 16 and cause the transmitter 11 to transmit a modulated radio frequency signal from the antenna 13 for maintaining synchronism of all of the lights.

Figure 9:
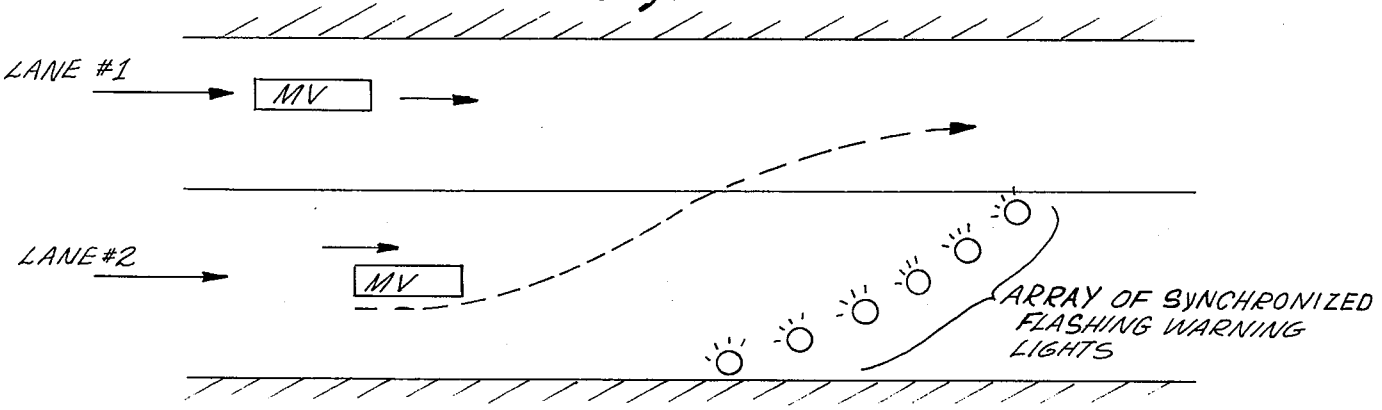
FIG. 9 is a diagrammatic representation of an array of synchronous flashing warning lights arranged on a highway for signaling a lane change employing the warning lights of the present invention.

Now referring to FIG. 9 wherein a typical arrangement of an array of warning lights is diagrammatically illustrated to indicate one of the number of uses for such warning lights. In FIG. 9, a two-lane highway is illustrated with a motor vehicle MV illustrated in block form in each of the lanes 1 and 2. Lane 2 is illustrated with an array of synchronous flashing warning lights of the type of the invention and arranged across the lane to signal a lane changing warning to the opeator of the motor vehicle MV in lane 2. As the motorist in lane 2 approaches the array of synchronous flashing warning lights arranged diagonally across the lane, the lights will continuously flash in synchronism so as to define the on and off flashing line to signal a lane change. The flashing lights are arranged in an angular relationship in the nature of a directional arrow to further provide the necessary intelligence to the motorist that the vehicle should be moved into the adjacent lane.

What is claimed is:

1. In combination a plurality of flashable warning lights arranged in a spaced apart relationship, each flashable light including a flashable lamp means for energizing the flashable lamp, said energizing means for each light including means for transmitting a radiant energy signal of a preselected frequency from the lamp to be transmitted to another flashable lamp, means for receiving a radiant energy signal of the said preselected frequency from each other flashable lamp and providing an output signal therefrom, resettable timing means for providing an output signal after a preselected time interval so that each light is illuminated at the same time interval in response to the resetting of the timing means.

said resettable timing means being coupled to be responsive to an output signal from the receiving means for causing the timing means to be reset prior to the expiration of the preselected time interval and provide an output signal indicative of the resetting, means coupling the output signal from the timing means to the lamp for momentarily energizing same and to said transmitting means for causing a signal to be transmitted from the lamp, and means for coupling the output signal from the receiving means to said timing means for resetting same.

2. A combination as defined in claim 1 wherein each of said transmitting means comprises means for transmitting radiant energy at a preselected radio frequency and each of said receiving means is tuned to be responsive to radiant energy at said preselected frequency.

3. A combination as defined in claim 2 wherein said transmitting means includes a transmitting/receiving antenna means for transmitting and receiving radiant energy and duplexing means for solely coupling the radiant energy from the transmitting means to the antenna and for solely coupling the energy received at the antenna to the receiving means.

4. A combination as defined in claim 3 wherein said transmitting means includes means for locally generating a signal, means for generating a coding signal and means for combining the locally generated signal and the coding signal for transmitting a coded signal therefrom.

5. A combination as defined in claim 3 wherein said local signal generating means comprises a radio frequency signal generating means and said coding signal generating means comprises means for generating a radio frequency modulating signal.

6. A radiant energy synchronized warning light flasher transceiver comprising radiant energy transmitting means, radiant energy receiving means, resettable timing means for controlling the time intervals that the transmitting means transmits a signal in response to a resetting timing signal, battery means for powering the transceiver, circuit means for conditioning the timing means to be reset in response to a signal received at the receiving means at a time just prior to the resetting time of the timing means to produce a resetting timing signal in response thereto, and means for controlling the transmitting time intervals of the transmitting means to a preselected portion of the light flashing time.

7. A radiant energy synchronized warning light flasher transceiver as defined in claim 6 wherein the transmitting means is constructed and defined for transmitting a coded signal and the receiving means is constructed and defined to receive a coded signal and provide a system control signal in response to the decoded signal received by the receiving means, means coupling the system control signal to said timing means for resetting same, and a warning light coupled to be powered from the battery means, and circuit means coupled to be responsive to the resetting timing signal to energize the warning light in synchronism with the transmission time of the transmitting means.

8. A radiant energy synchronized warning light flasher transceiver comprising a radiant energy transmitting means, radiant energy receiving means, and transceiving antenna means individually coupled to the transmitting means and the receiving means, said transmitting means comprising means for generating a radiant energy carrier signal, means for generating a carrier signal modulating signal, means for combining the carrier and modulating signal timing means for providing gating signals at preselected time intervals to cause the transmitter to transmit a modulated carrier signal at said preselected intervals, gating means coupled to be responsive to the modulating signal means and the carrier signal means and the gating signals from the timing means for providing an output signal in response to the timing signals for coupling the modulating signal and the carrier signal to the combining means to cause a modulated radiant energy signal to be transmitted from the antenna means for a preselected time duration at preselected time intervals, and a flashable lamp coupled to be energized for a preselected time duration at said preselected time intervals in response to the output signal from the gating means.

9. A radiant energy synchronized warning light flasher transceiver as defined in claim 8 wherein the transceiver includes battery means for powering the transceiver and the gating means includes means for controlling the transmission time of the transmitting means to a preselected portion of the lamp flashing time to conserve battery power.

10. A method of operating an array of warning lights including the steps of arranging a plurality of warning lights in an array, providing each warning light with a self-contained radiant energy transceiving system for transmitting a radiant energy signal to each other light of the array, and for receiving a radiant energy signal from the other lights of the array, coding the signals transmitted from each light to prevent reception at the lights of non-light generated signals, controlling the lights to cause them to all illuminate at preselected time intervals for preselected time durations including in response to the reception of a light generated signal from another one of the lights to assure the synchronous illumination of all of the lights of the array at said preselected time intervals, the step of controlling the lights includes providing resettable timing means for controlling the time of illumination of each light so that each light is illuminated at the same time interval in response to the resetting of the timing means, and conditioning the timing means to be reset in response to a signal received from another one of the warning lights to assure synchronous flashing of all of the warning lights of an array, and controlling the transmission of the coded signals to restrict the signal transmission time to a preselected fraction of the time duration of the light's illumination during the preselected time intervals.

11. A method of operating an array of warning lights including the steps of arranging a plurality of warning lights in an array, providing each warning light with a self-contained radiant energy receiver and transmitter and power source, tuning each receiver to receive the same radiant energy frequency and the transmitter to radiate a signal at the same frequency to each other light of the array, arranging the transmitter and receiver for each light to be normally in a non-transmitting and non-receiving mode by decoupling them from the power source, providing each light with a resettable timing means to periodically couple the power source to the individual transmitter for radiating a signal at the termination of a preselected timing period and resetting the timing period, causing the receiver of each light to be coupled to the power source at a preselected time interval immediately prior to the termination of the preselected timing period of the timing means to receive a signal from one of the other lights of the array, powering the transmitter and resetting the timing means in response to the reception of a signal at one warning light from another light of the array to radiate a signal from the transmitter in response thereto, and transmitting a signal in response to the resetting of the timing means from each transmitter of each warning light.

12. A method of operating an array of warning lights as defined in claim 11 including the steps of arranging the lamps of each warning light to be normally decoupled from the power source, and coupling the lamps of each light to the power source to momentarily energize the lamps during the time intervals the individual transmitters are coupled to the power source.

13. A method of operating an array of warning lights as defined in claim 12 including the step of controlling the coupling of the transmitter to the power source to cause the transmitter to be powered for a preselected portion of the time intervals that the lamps are coupled thereto.

14. A method of operating an array of warning lights as defined in claim 13 including the step of momentarily energizing the receiver of each warning light of the array upon initially applying the power source to a warning light to receive a signal.

* * * * *

UNITED STATES PATENT OFFICE

CERTIFICATE OF CORRECTION

Patent No. 4,132,983 Dated January 2, 1979

Inventor(s) Haskell Shapiro

It is certified that error appears in the above-identified patent and that said Letters Patent are hereby corrected as shown below:

Column 3, line 63, the word "For" should read -- The --

Column 8, line 36, "Q" should read -- $\bar{Q}$ -- line 37, "quadrature" should read -- quadruple -- line 48, "Q" should read -- $\bar{Q}$ -- line 54, "Q" should read -- $\bar{Q}$ -- line 57, "Q" should read -- $\bar{Q}$ -- line 64, "Q" should read -- $\bar{Q}$ --

Signed and Sealed this

*Eighth* Day of *May 1979*

[SEAL]

*Attest:*

RUTH C. MASON
*Attesting Officer*

DONALD W. BANNER
*Commissioner of Patents and Trademarks*